US006952837B1

(12) United States Patent
Aoki

(10) Patent No.: US 6,952,837 B1
(45) Date of Patent: Oct. 11, 2005

(54) BALL CATCHING APPARATUS

(75) Inventor: Akio Aoki, Osaka (JP)

(73) Assignee: Trion Corporation, Osaka (JP)

( * ) Notice: Subject to any disclaimer, the term of this patent is extended or adjusted under 35 U.S.C. 154(b) by 0 days.

(21) Appl. No.: 10/918,611

(22) Filed: Aug. 13, 2004

(51) Int. Cl.[7] ..... A41D 13/08
(52) U.S. Cl. ..... 2/19
(58) Field of Search ..... 2/16, 19, 20, 158–163; 473/205

(56) References Cited

U.S. PATENT DOCUMENTS 2,778,023 A * 1/1957 Tompkins ..... 2/19
4,665,561 A * 5/1987 Aoki ..... 2/19
5,367,707 A * 11/1994 Murai ..... 2/19
5,457,819 A * 10/1995 Aoki ..... 2/19
5,850,633 A * 12/1998 Lovin ..... 2/19
6,347,402 B1 * 2/2002 Aoki ..... 2/19
6,487,724 B1 12/2002 Aoki ..... 2/19
6,516,470 B1 * 2/2003 Aoki ..... 2/19
6,536,046 B1 * 3/2003 Gilligan ..... 2/19

* cited by examiner

*Primary Examiner*—Gary L. Welch
(74) *Attorney, Agent, or Firm*—Knobbe Martens Olson & Bear, LLP

(57) ABSTRACT

A ball-catching apparatus includes a main body; a first piece attached to the main body via a first inner leather piece near a thumb pocket of the main body; a second piece attached to the main body via a second inner leather piece for wrapping the little finger and the ring finger; a first band member attached at its one end to the first piece and being free at the other end; and a second band member attached at its one end to the second piece and being free at the other end. The first band member and the second band member are connectable and disconnectable to each other for fastening the thumb inserted into the thumb pocket and for exerting and releasing pressing force on the little and ring fingers.

13 Claims, 3 Drawing Sheets

BALL CATCHING APPARATUS

BACKGROUND OF THE INVENTION

1. Field of the Invention

The present invention relates to a ball-catching apparatus such as a glove or a mitt for use in sports such as baseball or softball.

2. Description of the Related Art

A ball-catching apparatus such as a glove or mitt for use in sports such as baseball or softball includes a thumb-hitching member for fitting the hand with the ball-catching apparatus. Conventionally, such a thumb-hitching member is merely formed from a band member capable of pressing the thumb from the index-finger side, and the portion of the thumb opposite to the index-finger side is pressed against the inner leather of the main body of the ball-catching apparatus.

However, with this construction, the thumb is merely pressed from the index-finger side, and therefore the thumb is not sufficiently fixed in position, thereby making it difficult to fit the hand with the ball-catching apparatus.

Therefore, the present inventor has invented a ball-catching apparatus which fits well with the hand thereby offering excellent fitting comfort quality (U.S. Pat. No. 6,487,724). More specifically, with this ball-catching apparatus, the thumb is pressed not only from the index-finger side, but also from the side opposite to the index-finger side, thereby stably fixing the thumb in position to the main body of the ball-catching apparatus. Furthermore, a band is pressed against the hand by a second band member, enabling stably fixing in position the portion of the hand near the wrist to the main body of the ball-catching apparatus.

However, in this ball-catching apparatus, an inner leather piece for wrapping the four fingers other than the thumb is integrally formed and therefore induces resistance to the bending motion of the little and ring fingers towards the ball-catching side, during ball-catching. Therefore, there has been required a ball-catching apparatus which induces less resistance to the motion of the little and ring fingers during ball-catching and therefore is suited for ball-catching action.

SUMMARY OF THE INVENTION

Therefore, it is an object of the present invention to further improve conventional ball-catching apparatus to provide a ball-catching apparatus which is suited for ball-catching action not only for the thumb but the entire hand and offers excellent fitting comfort quality when fit on the hand.

The ball-catching apparatus according to the present invention has characteristics and configurations as follows.

The ball-catching apparatus comprising:

a main body of said ball-catching apparatus;

a first piece separated from said main body and coupled at the base end portion of a thumb pocket to said glove main body through a first inner leather piece, said first piece being capable of following the bending motion of the thumb during ball-catching;

a second piece separated from said main body and coupled to said glove main body through a second inner leather piece for wrapping the little finger and the ring finger, said second piece being capable of following the bending motion of said little and ring fingers during ball-catching;

a first band member sewed at its one end side to said first inner leather piece near the base end of said thumb pocket and engaged at the other end portion with said first piece, said other end being a free end; and a second band member attached at its one end side to said second piece, the other end side being a free end;

wherein said first band member and said second band member may be connected or disconnected to fasten the thumb inserted into said thumb pocket to fix or unfix the thumb in position and also to exert or release a pressing force on said little and ring fingers, said thumb and the back of the hand in the hand-width direction along which said back of the hand is to be received and supported.

With this configuration, there is reduced resistance to the bending motion of the little finger and the ring finger towards the ball-catching side during ball catching, making it easier to perform folding motion of the thumb, the little and ring fingers during ball-catching. This enables holding the ball at the center of the ball-catching apparatus, ensuring that the ball is caught. Furthermore, the pressing force pressing the back of the hand may be adjusted to optimize the fitting comfort quality. In this case, the first band member and the second band member may be connected with various methods.

Consequently, there may be provided a ball-catching apparatus which is suited for ball-catching action not only for the thumb but the entire hand and offers excellent fitting comfort quality when fit on the hand.

Preferably, a coupling member couplable to said second band member is mounted to the tip of the free end side of said first band member, and said first band member and said second band member may be connected or disconnected thorough this coupling member.

With this configuration, the actions of connecting or disconnecting the first and second band members may be performed through the coupling member to eliminate complicacy of the connecting and disconnecting actions, easing and ensuring these actions. The coupling member may be either a coupling member which directly connects the first and second band members or a coupling member which indirectly connects both the band members through other members.

Preferably, there is formed a plain fastener by which said second piece and said second band member are detachably attached to each other by contacting the surface of said second piece and the back side near the tip of the free end of said second band member with each other, and said first band member and said second band member may be connected or disconnected by engaging said second band member with said coupling member.

With this configuration, the actions of connecting or disconnecting the first and second band members may be performed in cooperation with the coupling member, which eases and speedups these connecting and disconnecting actions and also further improves the fitting comfort quality for the thumb, the little and ring fingers, the back of the hand.

DETAILED DESCRIPTION OF THE PREFERRED EMBODIMENTS

Figure 1:
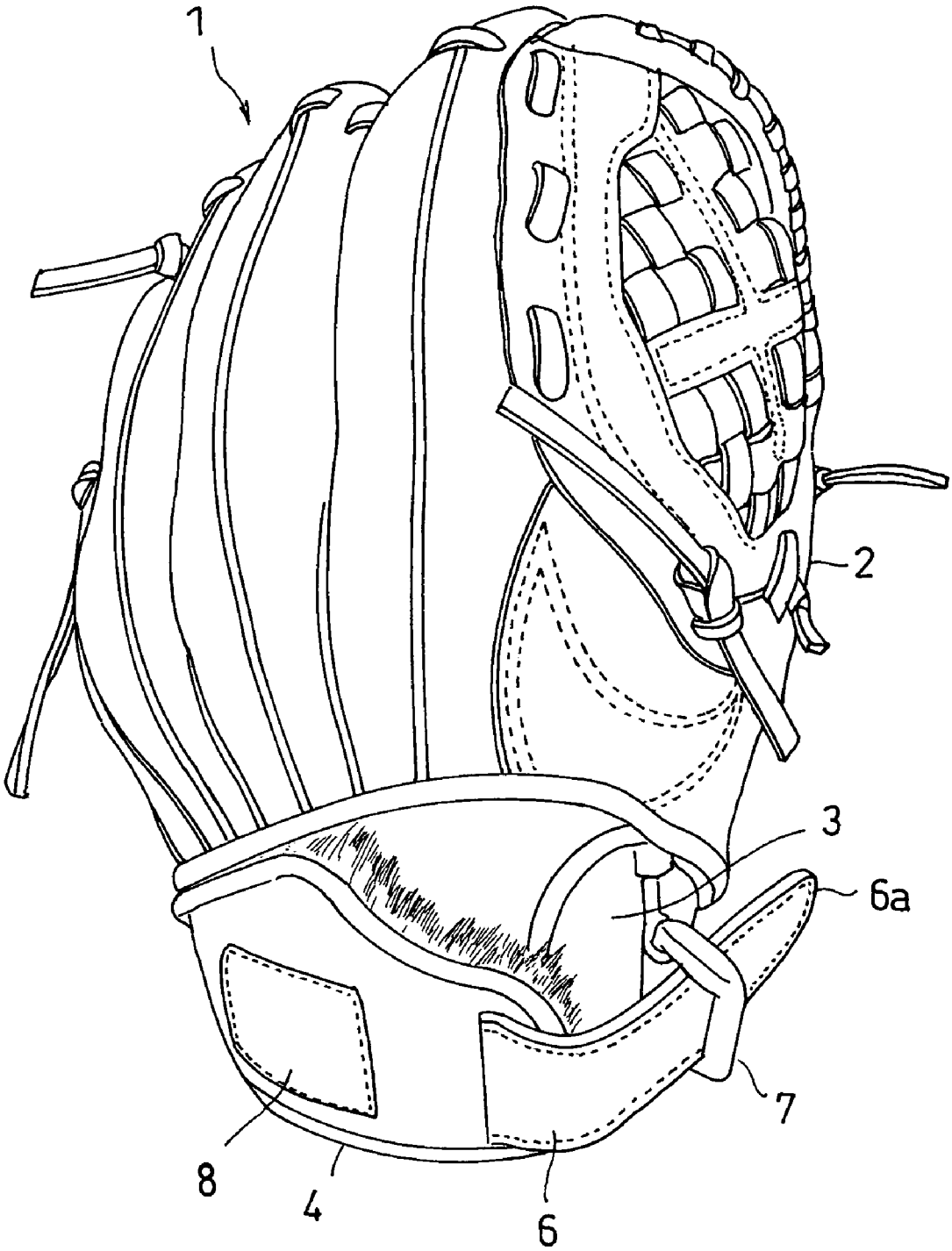
FIG. 1 is a perspective view of the ball-catching apparatus according to the present invention, illustrating the side of the back of the hand.
Figure 2:
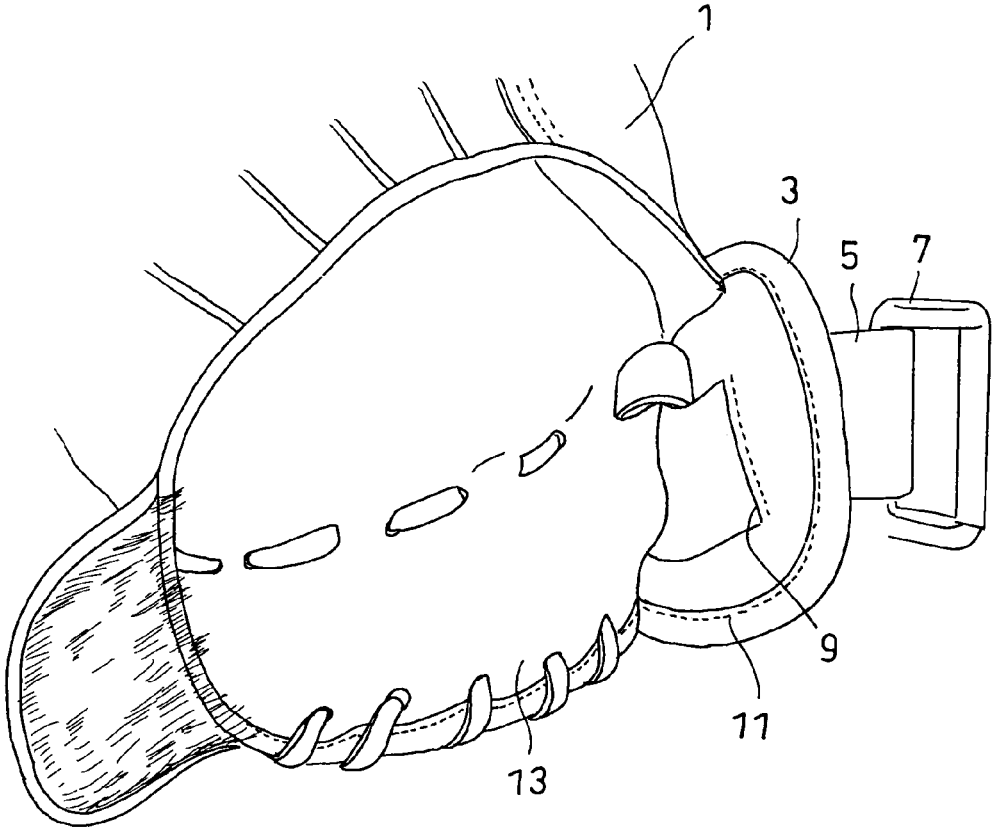
FIG. 2 is a main-parts perspective view of the ball-catching apparatus, illustrating the side of the hand insertion opening.

A preferred embodiment of a ball-catching apparatus according to the present invention will be explained in detail with reference to the drawings. FIGS. 1 and 2 illustrate an open-type baseball glove (hereinafter, abbreviated as a glove), which is one type of a ball-catching apparatus.

The glove is configured to includes a glove main body (corresponding to the main body of a ball-catching apparatus) 1, a first piece 3 separated from the glove main body 1 and coupled at the base end portion of a thumb pocket 2 to the glove main body 1 through a first inner leather piece 11, and a second piece 4 separated from the glove main body 1 and coupled to the glove main body 1 through a second inner leather piece 12 (this will be described later), the second piece 4 being extended in the hand-width direction for supporting the back of the hand. As will be described later, the first piece 3 and the second piece 4 may be brought close to each other by a second band member 6 sewed onto the second piece 4 and are configured to be capable of exerting and releasing a pressing force onto the hand being inserted into the glove. The reference numeral 13 denotes a hand insertion opening.

As illustrated in FIG. 1, the first piece 3 is provided foldably and adjacently relative to the base end portion of the thumb pocket 2 through the first inner leather piece 11 and is adapted to easily follow the bending motion of the thumb during ball-catching. Further, the first piece 3 includes a through hole 9 formed therein. The through hole 9 is sewed at its one end portion to the first inner leather piece 11, and an other end side of a first band member 5 capable of fastening the thumb may be inserted through the through hole 9. At the tip of the other end side of the first band member 5, a coupling member 7 couplable to a second band member 6 is mounted. The coupling member 7 is a rectangular belt loop made from resin. The tip end portion of the second band member 6 sewed to the second piece 4 may be inserted through and engaged with the belt loop 7 to couple them to exert a pressing force onto the hand. On the contrary, by disengaging the second band member 6 from the belt loop 7, the pressing force may be released. Thus, the first piece 3 functions as a thumb-hitching member in corporation with the first band member 5.

The hook portion 8 of a plain fastener is sewed onto the surface of the second piece 4. One end side of the second band member 6 is sewed to the second piece 4 at a position spaced from the hook portion 8 of the plain fastener towards the first piece 3. Once the hand has been inserted through the hand inserting opening, the tip 6*a* of the other end side, which is a free end, of the second band member 6 is inserted through the belt loop 7 at the other end side of the first band member 5, as illustrated in FIG. 1. Then, the tip 6*a* of the second band member 6 is folded back and pulled toward the second piece 4 side to contact a loop portion formed at the back side of the tip 6*a* of the second band member 6 with the hook portion 8 of the plain fastener on the second piece 4 to attach them. As a result, the second piece 4 presses the wrist and a portion of the back of the hand to firmly fit the hand with the glove. The tip end 6*a* of the second band member 6 may be easily disengaged from the hook portion 8 of the plain fastener on the second piece 4 and therefore the strength of the fastening force on the wrist may be adjusted.

As previously described, the second piece 4 is sewed to the glove main body 1 through the second inner leather piece 12. This may reduce the resistance to the ball-catching action, allowing the ball-catching action to be performed smoothly, as compared with the case of using an inner leather piece wrapping the four fingers other than the thumb as prior art. Namely, it becomes possible to perform, during ball-catching, the motion of the ring finger, little finger and thumb at the opposite sides of the hand for holding a ball among these fingers, independently. Therefore, the little and ring fingers are not restricted by an inner leather piece wrapping the other fingers as conventional gloves and therefore the degree of freedom of the ball-holding motion of the little and ring fingers is increased. Consequently, during ball-catching, the caught ball is naturally held at the center of the glove. Furthermore, since the second piece 4 is separated from the glove main body 1, it is possible to easily perform the bending motion of the fingers in association with the ball catching action. This further ensures that the ball is caught. Furthermore, since the second piece 4 covers not only the back of the hand inserted but also the wrist, the glove offers excellent fitting comfort quality.

Next, the second inner leather piece 12 will be explained with reference to FIG. 3. The second inner leather piece 12 is superposed on a little finger position 14*a* and a ring finger position 14*b* of an palm-side inner leather piece 14 and sewed at the outer edge onto the palm-side inner leather piece 14 to be formed into a pocket shape. Thus, the little finger and the ring finger are inserted between the second inner leather piece 12 and the palm-side inner leather piece 14. For the middle finger and the index finger, inner leather pieces 15, 16 which are separated from each other are superposed on a middle finger position 14*c* and an index finger position 14*d* of the palm-side inner leather piece 14 and sewed at the outer edge onto the palm-side inner leather piece 14. Thus, the middle and index fingers are inserted therebetween.

Figure 3:
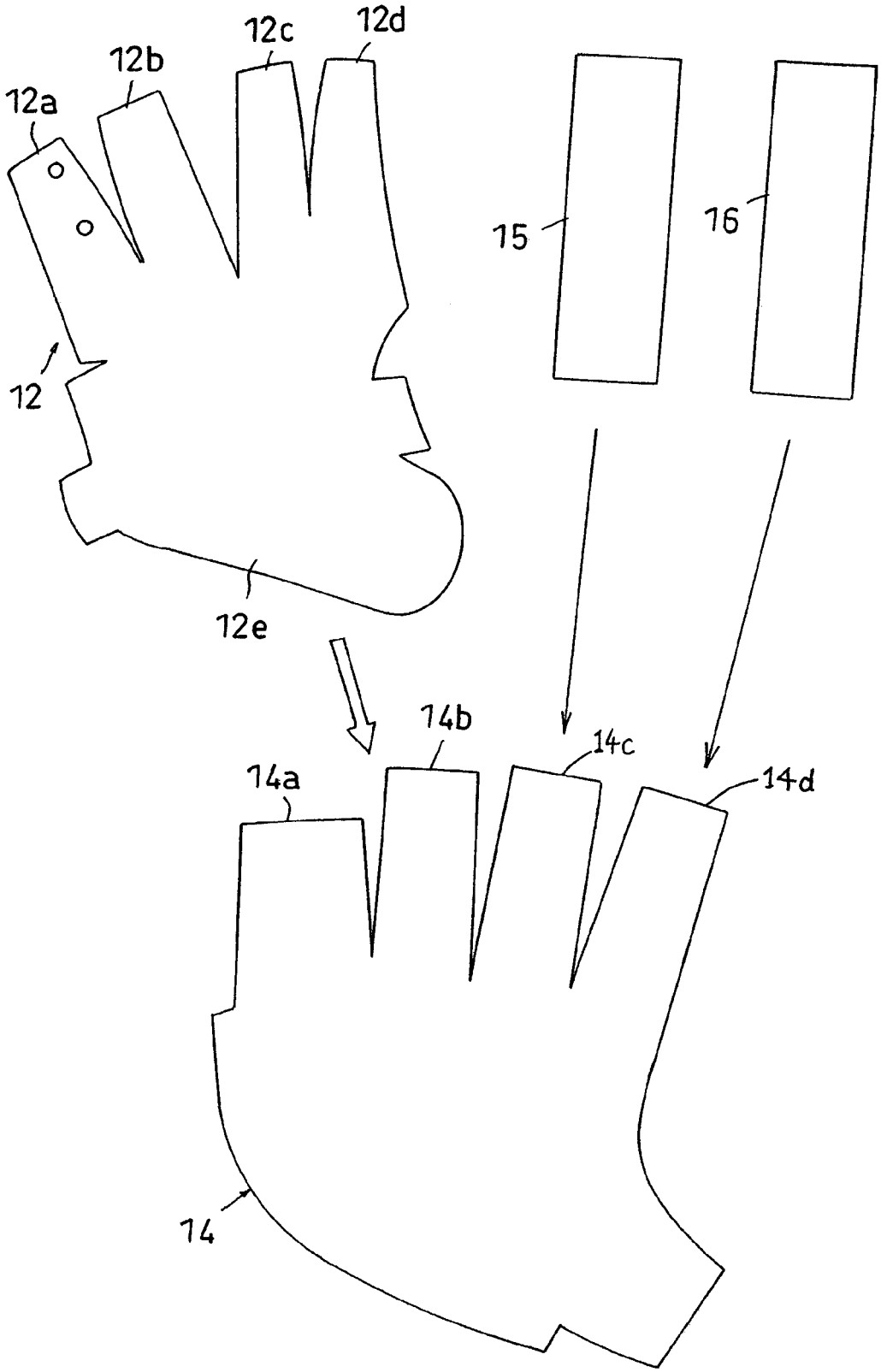
FIG. 3 is a developed view of the second inner leather piece.

The second inner leather piece 12 is shaped to wrap only the little finger and ring fingers, as illustrated in FIG. 3. Namely, the second inner leather piece 12 includes protruding portions 12*a*, 12*b* for laterally wrapping the little finger and protruding portions 12*c*, 12*d* for laterally wrapping the ring finger. The protruding portions 12*a*, 12*b* and the protruding portions 12*c*, 12*d* are sewed at the respective slits therebetween to each other to be formed into a shape projected to some degree toward the back of the hand. The protruding portions 12*a*, 12*b* and the protruding portions 12*c*, 12*d* are then superposed on the little finger position 14*a* and the ring finger position 14*b* of the palm-side inner leather piece 14 and sewed thereto to be formed into a pocket shape. Consequently, during the ball-catching action, the little and ring fingers inserted into the pocket-shaped second inner leather piece 12 work integrally and are not subjected to resistance of the inner leather piece wrapping the other fingers. Further, as previously described, the base portion 12*e* of the second inner leather piece 12 is coupled to the second piece 4 and the second piece 4 is coupled to the first piece 3. Therefore, in ball-catching, the second inner leather piece 12 may also work in conjunction with the bending motion of the thumb, ensuring that the ball is caught.

(1) While in the above embodiment the hook portion 8 of the plain fastener is formed on the surface of the second piece 4 and the loop portion attachable to the hook portion 8 is formed on the back side of the tip end 6*a* of the second band member 6, the hook portion 8 may be formed on the back side of the tip end 6*a* of the second band member 6 and the loop portion may be formed on the surface of the second piece 4. Also, any other coupling methods may be employed.

(2) The present invention is applicable to a catcher mitt and a first mitt and also applicable to a glove, a catcher mitt and a first mitt for soft ball.

What is claimed is:

1. A ball-catching apparatus comprising:

a main body of said ball-catching apparatus;

a first piece separated from said main body and coupled at the base end portion of a thumb pocket to said main body through a first inner leather piece, said first piece being capable of following the bending motion of the thumb during ball-catching;

a second piece separated from said main body and coupled to said main body through a second inner leather piece for wrapping the little finger and the ring finger, said second piece being capable of following the bending motion of said little and ring fingers during ball-catching;

a first band member sewed at its one end side to said first inner leather piece near the base end portion of said thumb pocket and engaged at the other end portion with said first piece, said other end being a free end; and a second band member attached at its one end side to said second piece, the other end side being a free end;

wherein said first band member and said second band member are connectable and disconnectable to each other for fastening the thumb inserted into said thumb pocket for fixing or unfixing the thumb in position and for exerting and releasing a pressing force on said little and ring fingers, said thumb and the back of the hand, in the hand-width direction along which said back of the hand is received and supported.

2. The ball-catching apparatus according to claim 1, wherein a belt loop couplable to said second band member is mounted to the tip of the free end side of said first band member, and said first band member and said second band member may be connected or disconnected thorough this belt loop.

3. The ball-catching apparatus according to claim 2, wherein there is formed a plain fastener with which said second piece and said second band member are detachably attached to each other by contacting the surface of said second piece and the back side near the tip of the free end of said second band member with each other, and said first band member and said second band member may be connected or disconnected by engaging said second band member with said belt loop.

4. A ball-catching apparatus comprising:

a main body of said ball-catching apparatus;

a first piece separated from said main body and coupled at the base end portion of a thumb pocket to said glove main body through a first inner leather piece, said first piece being capable of following the bending motion of the thumb during ball-catching;

a second piece separated from said main body and coupled to said glove main body through a second inner leather piece for wrapping the little finger and the ring finger, said second piece being capable of following the bending motion of said little and ring fingers during ball-catching;

a first band member sewed at its one end side to said first inner leather piece near the base end portion of said thumb pocket and engaged at the other end portion with said first piece, said other end being a free end; and a second band member attached at its one end side to said second piece, the other end side being a free end;

wherein said first band member and said second band member are connectable and disconnectable to each other for fastening the thumb inserted into said thumb pocket for fixing or unfixing the thumb in position and for exerting and releasing a pressing force on said little and ring fingers, said thumb and the back of the hand, in the hand-width direction along which said back of the hand is received and supported, and wherein said second inner leather piece wraps only the little and ring fingers and sewed to said second piece extended in the hand-width direction for supporting the back of the hand.

5. A ball-catching tool for a hand comprising:

a main body;

a first piece attached to the main body via a first inner leather piece near a thumb pocket of the main body;

a second piece attached to the main body via a second inner leather piece for wrapping the little finger and the ring finger;

a first band member attached at its one end to the first piece and being free at the other end; and a second band member attached at its one end to the second piece and being free at the other end;

wherein the first band member and the second band member are connectable and disconnectable to each other using the respective free ends for fastening the thumb inserted into the thumb pocket and for exerting and releasing pressing force on the little and ring fingers.

6. The tool according to claim 5, wherein the main body comprises a palm-side inner leather piece which is attached to the second inner leather pieces to form pockets for the little and ring fingers.

7. The tool according to claim 5, further comprising a belt loop which is attached to the other end of the first band member for engaging with the second band member.

8. A ball-catching apparatus comprising:

a main body of said ball-catching apparatus;

a first piece separated from said main body and coupled at the base end portion of a thumb pocket to said main body through a first inner leather piece, said first piece having a through hole therein and being capable of following the bending motion of the thumb during ball-catching;

a second piece separated from said main body and coupled to said main body through a second inner leather piece for wrapping the little finger and the ring finger, said second piece being capable of following the bending motion of said little and ring fingers during ball-catching;

a first band member sewed at its one end side to said first inner leather piece near the base end portion of said thumb pocket and engaged at the other end portion with said first piece, said other end being a free end; and a second band member attached at its one end side to said second piece, the other end side being a free end;

wherein said first band member is inserted through said through hole, and said first band member and said second band member are connectable and disconnectable to each other for fastening the thumb inserted into said thumb pocket for fixing or unfixing the thumb in position and for exerting and releasing a pressing force on said little and ring fingers, said thumb and the back of the hand, in the hand-width direction along which said back of the hand is received and supported.

9. The ball-catching apparatus according to claim 8, further comprising a belt loop which is attached to the other end of the first band member for engaging with the second band member.

10. The ball-catching apparatus according to claim 9, further comprising a plain fastener with which said second piece and said second band member are detachably attached to each other by contacting the surface of said second piece and the back side near the tip of the free end of said second band member with each other, and said first band member and said second band member may be connected or disconnected by engaging said second band member with said belt loop.

11. A ball-catching tool for a hand comprising:

a main body;

a first piece attached to the main body via a first inner leather piece near a thumb pocket of the main body;

a second piece attached to the main body via a second inner leather piece for wrapping the little finger and the ring finger, said second inner leather piece being sewed to said second piece extended in the hand-width direction for supporting the back of the hand;

a first band member attached at its one end to the first piece and being free at the other end; and a second band member attached at its one end to the second piece and being free at the other end;

wherein the first band member and the second band member are connectable and disconnectable to each other using the respective free ends for fastening the thumb inserted into the thumb pocket and for exerting and releasing pressing force on the little and ring fingers.

12. The tool according to claim 11, wherein the main body comprises a palm-side inner leather piece which is attached to the second inner leather pieces to form pockets for the little and ring fingers.

13. The tool according to claim 11, further comprising a belt loop which is attached to the other end of the first band member for engaging with the second band member.

* * * * *